US010525730B2

(12) United States Patent
Ishii

(10) Patent No.: US 10,525,730 B2
(45) Date of Patent: Jan. 7, 2020

(54) THERMAL HEAD AND THERMAL PRINTER

(71) Applicant: KYOCERA Corporation, Kyoto-shi, Kyoto (JP)

(72) Inventor: Yoshinobu Ishii, Omihachiman (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 16/064,477

(22) PCT Filed: Dec. 22, 2016

(86) PCT No.: PCT/JP2016/088356
§ 371 (c)(1),
(2) Date: Jun. 21, 2018

(87) PCT Pub. No.: WO2017/111007
PCT Pub. Date: Jun. 29, 2017

(65) Prior Publication Data

US 2018/0370248 A1 Dec. 27, 2018

(30) Foreign Application Priority Data

Dec. 25, 2015 (JP) ..... 2015-254150

(51) Int. Cl.
*B41J 2/33* (2006.01)
*B41J 2/335* (2006.01)

(52) U.S. Cl.
CPC ..... *B41J 2/3351* (2013.01); *B41J 2/3352* (2013.01); *B41J 2/3353* (2013.01); *B41J 2/3355* (2013.01); *B41J 2/33535* (2013.01)

(58) Field of Classification Search
None
See application file for complete search history.

(56) References Cited

U.S. PATENT DOCUMENTS

2007/0296797 A1* 12/2007 Yamade ..... B41J 2/3351 347/202
2012/0133724 A1* 5/2012 Nishi ..... B41J 2/335 347/204

FOREIGN PATENT DOCUMENTS

CN 103269862 A 8/2013
JP 1-166535 U 11/1989
JP 5-24234 A 2/1993
WO WO-2012086558 A1 * 6/2012 ..... B41J 2/3351

* cited by examiner

*Primary Examiner* — Matthew Luu
*Assistant Examiner* — Tracey M McMillion
(74) *Attorney, Agent, or Firm* — Volpe and Koenig, P.C.

(57) ABSTRACT

A thermal head according to the present disclosure includes: a substrate; a first electrode; a heat generating section; a second electrode; a resin layer; and a protective layer. The first electrode is located on the substrate. The heat generating section is located on the substrate. The second electrode is located on the substrate so as to be electrically connected to the heat generating section and the first electrode. The resin layer is located on the first electrode. The protective layer is located on the resin layer. Moreover, the resin layer includes a first portion inserted in the first electrode.

14 Claims, 8 Drawing Sheets

THERMAL HEAD AND THERMAL PRINTER

TECHNICAL FIELD

The present invention relates to a thermal head and a thermal printer.

BACKGROUND ART

As printing devices for use in facsimiles, or video printers, etc., various types of thermal heads have been proposed to date. For example, a thermal head comprises a substrate, a first electrode, a heat generating section, a second electrode, and a protective layer. The first electrode is located on the substrate. The heat generating section is located on the substrate. The second electrode is located on the substrate so as to be electrically connected to the heat generating section and the first electrode. The protective layer is located on the first electrode.

CITATION LIST

Patent Literature

Patent Literature 1: Japanese Unexamined Patent Publication JP-A 5-24234 (1993)

SUMMARY OF INVENTION

A thermal head according to the present disclosure comprises: a substrate; a first electrode; a heat generating section; a second electrode; a resin layer; and a protective layer. The first electrode is located on the substrate. The heat generating section is located on the substrate. The second electrode is located on the substrate so as to be electrically connected to the heat generating section and the first electrode. The resin layer is located on the first electrode. The protective layer is located on the resin layer. Moreover, the resin layer comprises a first portion inserted in the first electrode.

A thermal printer according to the present disclosure comprises: the thermal head described above; a conveyance mechanism which conveys a recording medium so as to pass over the heat generating section; and a platen roller which presses the recording medium.

DESCRIPTION OF EMBODIMENTS

Some conventional thermal heads employ a thick first electrode for a reduction in electrical resistance. However, an increase in thickness of the first electrode gives rise to an appreciable difference in thermal expansion coefficient between the first electrode and a protective layer formed of an inorganic material, and consequently a stress may be concentrated at the interface between the first electrode and the protective layer, causing a separation of the protective layer.

In a thermal head according to the present disclosure, such a protective layer separation can be reduced. Following is a detailed description of the thermal head according to the present disclosure and a thermal printer using the thermal head.

First Embodiment

Figure 1:
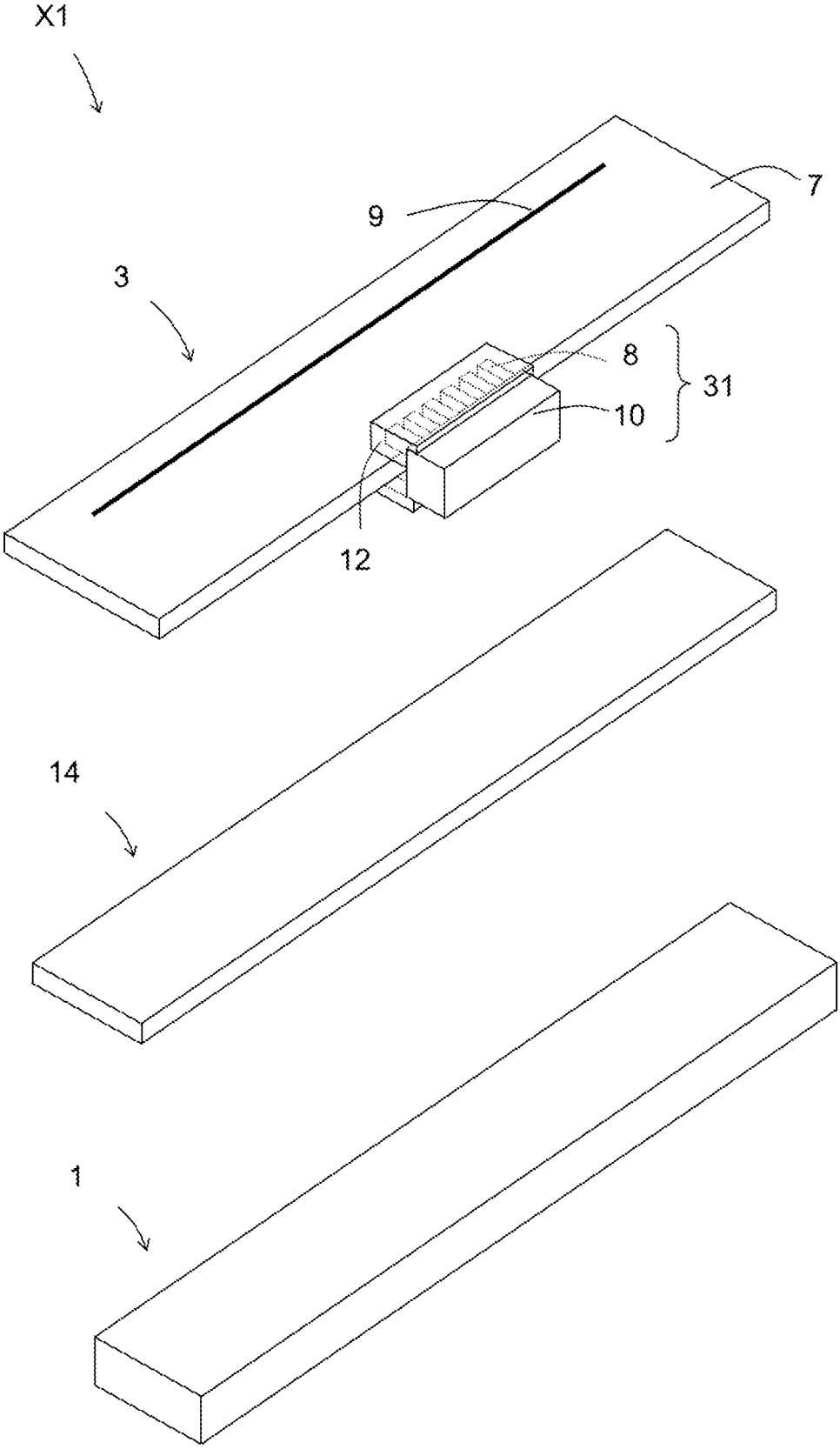
FIG. 1 is an exploded perspective view in schematic form showing a thermal head according to a first embodiment.
Figure 2:
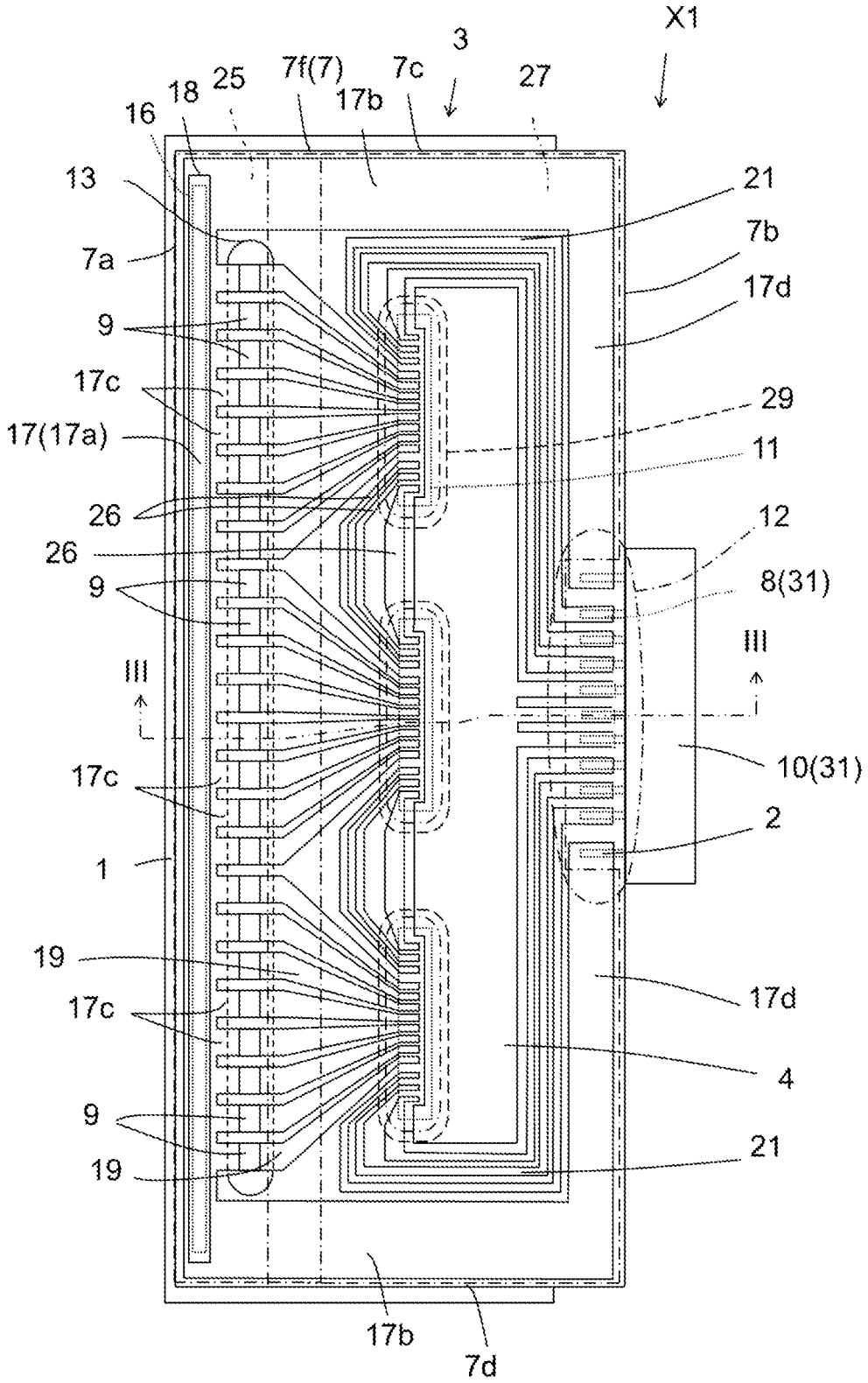
FIG. 2 is a plan view in schematic form showing the structure of the thermal head shown in FIG. 1.

Hereinafter, a thermal head X1 will be described with reference to FIGS. 1 to 4B. FIG. 1 schematically shows the structure of the thermal head X1. In FIG. 2, a protective layer 25, a cover layer 27, and a sealing member 12 are indicated by alternate long and short dashed lines.

The thermal head X1 comprises: a head base body 3; a connector 31; a sealing member 12; a heat dissipating plate 1; and a bonding member 14. The heat dissipating plate 1 is provided to dissipate heat liberated by the head base body 3. The head base body 3 is placed on the heat dissipating plate 1 via the bonding member 14. The head base body 3 performs printing on a recording medium P (refer to FIG. 5) by operating a heat generating section 9 so as to generate heat under application of external voltage. The bonding member 14 bonds the head base body 3 and the heat dissipating plate 1. The connector 31 electrically connects the head base body 3 and the exterior thereof. The sealing member 12 joins the connector 31 and the head base body 3.

The heat dissipating plate 1 is shaped in a rectangular parallelepiped. For example, the heat dissipating plate 1 is formed of a metal material such as copper, iron, or aluminum. The heat dissipating plate 1 functions to dissipate part of the heat generated in the heat generating section 9 of the head base body 3 which part is not conducive to printing.

The head base body 3 is rectangular as seen in a plan view, and, on a substrate 7 of the head base body 3, individual members constituting the thermal head X1 are provided. The head base body 3 functions to perform printing on the recording medium P in response to an externally supplied electric signal.

Figure 3:
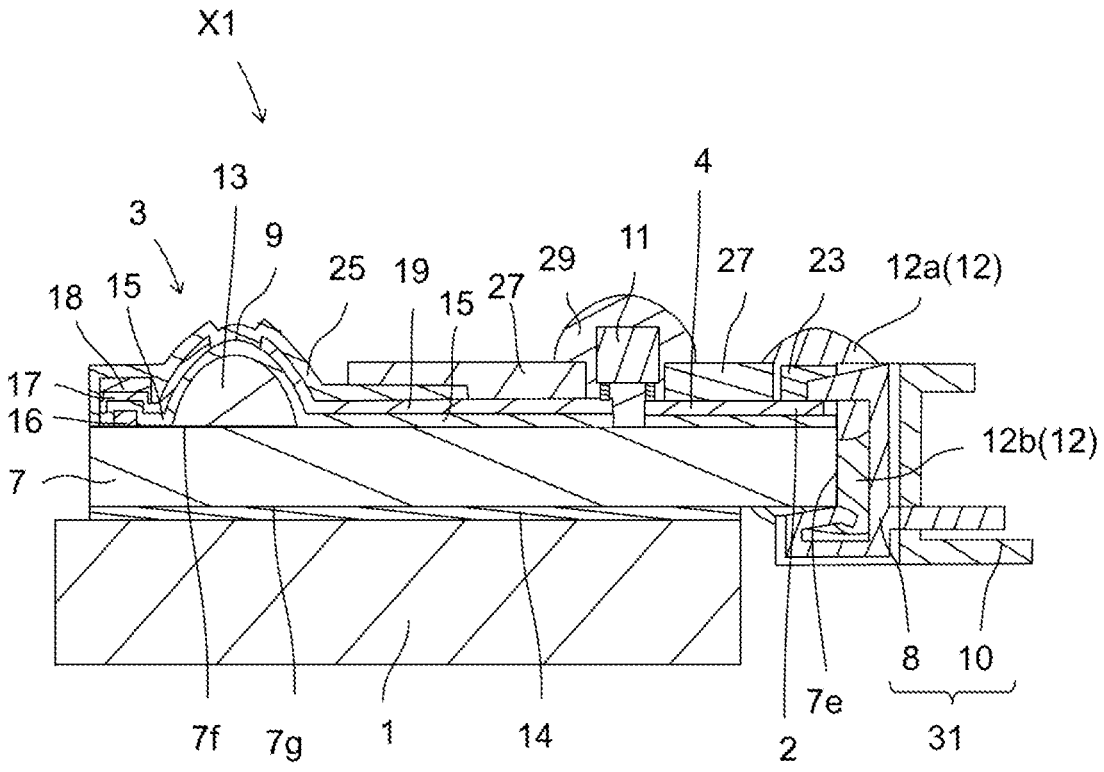
FIG. 3 is a sectional view taken along the line III-III shown in FIG. 2.

Now, the constituent members of the head base body 3 will be described with reference to FIGS. 1 to 3.

The substrate 7 is disposed on the heat dissipating plate 1, is rectangular as seen in a plan view. The substrate 7 has a first face 7*f*, a second face 7*g*, and a side face 7*e*. The side face 7*e* connects the first face 7*f* and the second face 7*g* and is located on the connector 31 side. The first face 7*f* has a first long side 7*a*, a second long side 7*b*, a first short side 7*c*, and a second short side 7*d*. On the first face 7*f*, members constituting the head base body 3 are provided. The second face 7*g* is located on the heat dissipating plate 1 side. For example, the substrate 7 is formed of an electrically insulating material such as alumina ceramics, or a semiconductor material such as single-crystal silicon.

On the first face 7*f* of the substrate 7, a heat storage layer 13 is provided. The heat storage layer 13 protrudes upward from the substrate 7, or, expressed differently, protrudes in a direction away from the substrate 7. The heat storage layer 13 extends in a main scanning direction. A sectional shape of the heat storage layer 13 is substantially semi-elliptical. The substantially semi-elliptical profile of the heat storage layer 13 serves for proper contact of the protective layer 25 formed on the heat generating section 9 with the recording medium P under printing (refer to FIG. 5). A height of the heat storage layer 13 from the substrate 7 is 15 to 90 μm.

The heat storage layer 13 is formed of glass having a low thermal conductivity, and temporarily stores part of the heat liberated by the heat generating section 9. Thus, the heat storage layer 13 can shorten the time required to raise the temperature of the heat generating section 9, and can improve thermal response characteristics of the thermal head X1. For example, the heat storage layer 13 is formed by applying a predetermined glass paste obtained by blending a suitable organic solvent in glass powder to the upper surface of the substrate 7 by a heretofore known process such as screen printing, and thereafter firing the glass paste.

A first electrode 16 is disposed on the substrate 7 so as to be elongated along the first long side 7*a* of the substrate 7 in the main scanning direction. The first electrode 16 is provided to reduce electrical resistance in the main scanning direction.

an electrical resistance layer 15 is disposed on the substrate 7, as well as on the heat storage layer 13, so as to cover the first electrode 16. On the electrical resistance layer 15, various electrodes including a second electrode 17 and a discrete electrode 19 are provided. In the following description, the second electrode 17 will be referred to as the common electrode 17. The electrical resistance layer 15 has a plurality of exposed regions, each in the form of an exposed region of the electrical resistance layer 15 which exposed region is disposed between the common electrode 17 and the discrete electrode 19. Each exposed region constitutes the heat generating section 9. The exposed regions are aligned in an array on the heat storage layer 13. The electrical resistance layer 15 may be formed only in a region between the common electrode 17 and the discrete electrode 19.

The plurality of heat generating sections 9, while being illustrated in simplified form in FIG. 2 for convenience in explanation, are arranged at a density of 100 dpi (dot per inch) to 2400 dpi, for example. The electrical resistance layer 15 is formed of a material having a relatively high electrical resistance such for example as a TaN-based material, a TaSiO-based material, a TaSiNO-based material, a TiSiO-based material, a TiSiCO-based material, or a NbSiO-based material. Thus, upon application of a voltage to the heat generating section 9, the heat generating section 9 generates heat under Joule heating effect.

The common electrode 17 comprises: main wiring portions 17*a* and 17*d*; sub wiring portions 17*b*; and lead portions 17*c*. The common electrode 17 electrically connects the connector 31 and the plurality of heat generating sections 9. The main wiring portion 17*a* is disposed on the first electrode 16 so as to extend along the first long side 7*a* of the substrate 7. The main wiring portion 17*a* and the first electrode 16 are electrically connected to each other via the electrical resistance layer 15. The sub wiring portions 17*b* extend along the first short side 7*c* and the second short side 7*d*, respectively, of the substrate 7. The lead portions 17*c* individually extend from the main wiring portion 17*a* toward the corresponding heat generating sections 9. The main wiring portion 17*d* extends along the second long side 7*b* of the substrate 7.

The plurality of discrete electrodes 19 electrically connect the heat generating section 9 and a driving IC 11. Moreover, the plurality of heat generating sections 9 are bunched together in a plurality of groups, and, the heat generating sections 9 in each group and corresponding one of the driving ICs 11 are electrically connected to each other by the discrete electrodes 19.

The thermal head X1 has a plurality of first electrodes 21 which electrically connect the driving IC 11 and the connector 31. The plurality of first connection electrodes 21 connected to respective driving ICs 11 are composed of a plurality of wiring lines having different functions.

The thermal head X1 has a ground electrode 4 which is surrounded by the discrete electrodes 19, the first connection electrodes 21, and the main wiring portions 17*d* of the common electrodes 17 and has a wide area. The ground electrode 4 is connected at a ground potential of 0 to 1 V.

The thermal head X1 has a connection terminal 2, located on the second long side 7*b* side of the substrate 7, for connecting the common electrode 17, the first connection electrode 21, and the ground electrode 4 to the connector 31. Each connection terminal 2 is connected to corresponding one of connector pins 8 of the connector 31.

The thermal head X1 has a plurality of second connection electrodes 26 which electrically connect adjacent driving ICs 11. The plurality of second connection electrodes 26, each assigned to the first connection electrode 21, transmit various signals to the adjacent driving ICs 11.

For example, the electrical resistance layer 15 and various electrodes are obtained by sequentially forming layers on the substrate 7, the heat storage layer 13, etc. by a thin-film forming process such as sputtering, and thereafter defining predetermined patterns in the stacked layers by a heretofore known technique such as photoetching. Thus, the various electrodes are electrically connected with the heat generating section 9 and the first electrode 16. Thicknesses of these electrodes can be set to 0.1 μm to 1 μm.

The thermal head X1 has a resin layer 18 disposed on the main wiring portion 17*a* of the common electrode 17. The resin layer 18 is disposed so as to cover the first electrode 16 as seen in a plan view.

As shown in FIG. 2, the driving IC 11 is assigned to each group of the plurality of heat generating sections 9, and is connected to the other end of the discrete electrode 19 and one end of the first connection electrode 21. The driving IC 11 functions to control the current-carrying condition of each heat generating section 9. As the driving IC 11, it is possible to use can a switching IC internally provided with a plurality of switching devices.

The driving IC 11, in a condition of being connected to the discrete electrode 19, the second connection electrode 26, and the first connection electrode 21, is sealed with a hard coating 29 formed of resin such as epoxy resin or silicone resin.

The protective layer 25 covers the heat generating section 9 and part of the common electrode 17 and the discrete electrode 19, thereby protecting the covered areas from corrosion caused by adhesion of atmospheric water content, etc., or from wear caused by contact with the recording medium under printing.

The protective layer 25 is formed of an inorganic material having electrical conductivity, such for example as TiN, TiCN, SiC, SiON, SiN, TaN, or TaSiO. For example, a thickness of the protective layer 25 can be set to 2 μm to 15 μm. The placement of the protective layer 25 make it possible to eliminate static electricity caused by contact with the recording medium P (refer to FIG. 5). For example, the protective layer 25 may be formed by sputtering or ion plating.

On the substrate 7, there is provided a cover layer 27 for partly covering the common electrode 17, the discrete electrode 19, and the first connection electrode 21. The cover layer 27 serves to protect the covered areas of the common electrode 17, the discrete electrode 19, the second connection electrode 26, and the first connection electrode 21 from oxidation caused by exposure to air, or corrosion caused by adhesion of atmospheric water content, etc. The cover layer 27 may be formed of a resin material such as epoxy resin, polyimide resin, or silicone resin.

The connector 31 and the head base body 3 are joined together via the connector pin 8, a conductive member 23, and the sealing member 12. The conductive member 23 is disposed between the connection terminal 2 and the connector pin 8. Exemplary of the conductive member 23 can be solder or ACP (Anisotropic Conductive Paste). A Ni-, Au-, or Pd-plating layer (not shown in the drawings) may be interposed between the conductive member 23 and the connection terminal 2. The conductive member 23 does not necessarily have to be provided.

The connector 31 comprises a plurality of connector pins 8 and a housing 10 for receiving the plurality of connector pins 8. Each of the plurality of connector pins 8 has one end exposed out of the housing 10, and has the other end received within the housing 10. The plurality of connector pins 8 are electrically connected to the connection terminal 2 of the head base body 3 and are electrically connected with the various electrodes of the head base body 3.

The sealing member 12 comprises a first sealing member 12*a* and a second sealing member 12*b*. The first sealing member 12*a* is located on the first face 7*f* of the substrate 7, and the second sealing member 12*b* is located on the second face 7*g* of the substrate 7. The first sealing member 12*a* seals the connector pin 8 and the various electrodes. The second sealing member 12*b* seals the connecting areas of the connector pin 8 and the substrate 7.

The sealing member 12 is placed so that the connection terminal 2 and the connector pin 8 are not be externally exposed. For example, the sealing member 12 is formed of a thermosetting epoxy resin, an ultraviolet-curable resin, or a visible light-curable resin. The first sealing member 12*a* and the second sealing member 12*b* may be formed either of the same material or of different materials.

The bonding member 14 is disposed on the heat dissipating plate 1 to join the heat dissipating plate 1 to the second face 7*g* of the head base body 3. Exemplary of the bonding member 14 can be a double-faced tape or a resin adhesive.

Figure 4A:
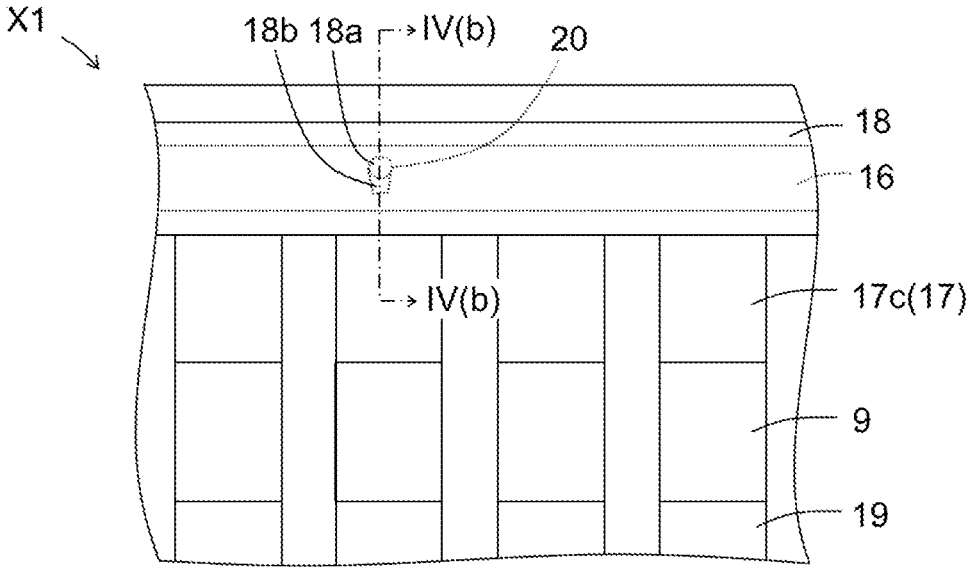
FIG. 4A is a plan view schematically showing a part near an insulating layer in the thermal head shown in FIG. 1.
Figure 4B:
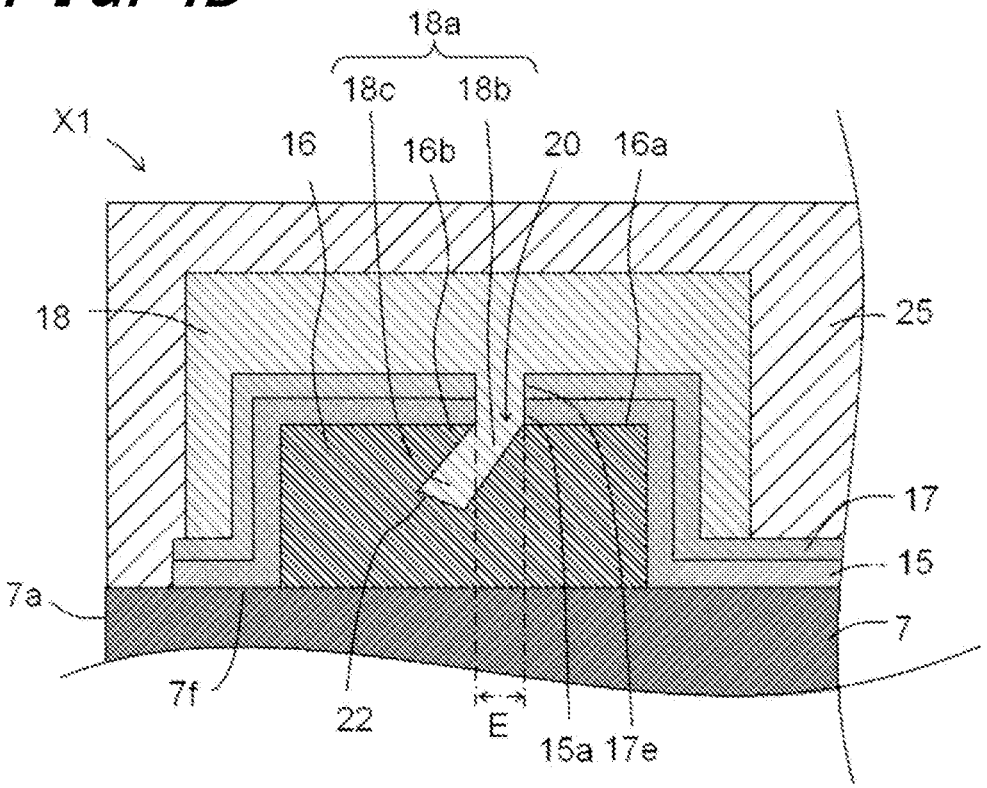
FIG. 4B is a sectional view taken along the line IV(b)-IV(b) shown in FIG. 4A.

Referring to FIGS. 4A and 4B, the first electrode 16 and the resin layer 18 will be described in detail. In FIG. 4A, the illustration of the protective layer 25 disposed on the resin layer 18 (refer to FIG. 3) is omitted.

The first electrode 16 is elongated along the first long side 7*a* of the substrate 7 in the main scanning direction. On the first electrode 16, the electrical resistance layer 15, the common electrode 17, and the resin layer 18 are provided. The first electrode 16 may be formed by a thick-film printing process using Ag paste, Au paste, etc. For example, a thickness of the first electrode 16 can be set to 5 μm to 30 μm.

The first electrode 16 has an upper surface 16 provided with a recess 22. The recess 22 is a portion recessed inwardly from the upper surface 16*a*. A portion by which part of the upper surface 16*a* of the first electrode 16 is made discontinuous when viewed in a section (a part of the recess 22 which is contiguous to the upper surface 16*a*), will be referred to as a discontinuity portion 20. The discontinuity portion 20 is substantially circular as seen in a plan view, and, the circular shape has a diameter of 0.5 μm to 5 μm, for example. In FIG. 4B, as indicated by alternate long and short dashed lines, imaginary lines extending in a thickness direction from the discontinuity portion 20 of the first electrode 16 represent a region E which corresponds to the discontinuity portion 20 in a thickness direction of the substrate 7. As employed herein "viewed in a section" refers to the viewing of the plane of section of each of the first electrode 16 and the resin layer 8 obtained by cutting the thermal head X1 in a direction perpendicular to the first face 7*f* of the substrate 7, which is exemplified in FIG. 4B. The direction of cutting the thermal head is not limited to a specific direction, and thus, for example, the thermal head may be cut so that the plane of section lies along the main scanning direction, or cut so that the plane of section lies along a sub scanning direction.

The recess 22 extends from the upper surface 16*a* of the first electrode 16 toward a direction having a component in a downward direction and a component in the main scanning direction. That is, the recess 22 extends so as to be inclined toward the first long side 7*a* side of the substrate 7 with respect to the thickness direction when viewed in a section. Note that the direction of inclination is not limited to the first long side 7*a* side of the substrate 7, but may be another direction.

On the first electrode 16, the electrical resistance layer 15 is provided. The electrical resistance layer 15 is provided with a second through hole 15*a*. The second through hole 15*a* is located on the discontinuity portion 20 of the first electrode 16. On the electrical resistance layer 15, the common electrode 17 is provided. The common electrode 17 is provided with a first through hole 17*e*. The first through hole 17*e* is located on the second through hole 15*a*, and is thus located above the discontinuity portion 20 of the first electrode 16. Thus, the first through hole 17*e* and the second through hole 15*a* are continuous with the recess 22 of the first electrode 16.

The resin layer 18 is disposed on the first electrode 16. The resin layer 18 has a first portion 18*a* inserted in the first electrode 16, and, the resin layer 18 disposed on the first electrode 16 and the first portion 18*a* are formed integrally with each other.

The first portion 18*a* is a part of the resin layer 18 which lies within the recess 22 of the first electrode 16, and thus the recess 22 is filled with the first portion 18*a*. That is, as shown in FIG. 4B, the resin layer 18 extends from above the first electrode 16 to the interior of the recess 22. The first portion 18*a* comprises a second portion 18*b* and a third portion 18*c*.

The second portion 18*b* is a part lying in the region E which corresponds to the discontinuity portion 20 in the thickness direction of the substrate 7, and is connected with a part of the resin layer 18 located on the first electrode 16. The third portion 18*c* constitutes other part of the first portion 18*a* than the second portion 18*b*, or equivalently a part which lies outside the region E, and, the third portion 18*c* is connected with the second portion 18*b*.

For example, a resin material such as epoxy resin, polyimide resin, or silicone resin is used for the resin layer 18. The resin layer 18 has a thickness of 5 μm to 20 μm, for example. The resin layer 18 may be formed by a thick-film forming technique, such as a printing method, following the completion of formation of the first electrode 16 and the subsequent patterning of the various electrodes.

In order to reduce electrical resistance in the thermal head X1 and the common electrode 17, a thick first electrode 16 is provided In the case of using the thick first electrode 16, the electrical resistance of the common electrode 17 can be reduced, but a stress is concentrated at the interface between the first electrode 16 and the protective layer 25 due to the difference in thermal expansion coefficient between the first electrode 16 and the protective layer 25 formed of an inorganic material.

In this regard, the resin layer 18 is interposed between the first electrode 16 and the protective layer 25, and this enables a lessening of the stress concentrated at the interface between the first electrode 16 and the protective layer 25. Moreover, the resin layer 18 has the first portion 18*a* inserted in the first electrode 16. The first portion 18*a* is in contact with the interior of the first electrode 16, with a consequent increase in the area of contact with first electrode 16. This makes it possible to enhance the strength of adhesion between the first electrode 16 and the resin layer 18. In consequence, the protective layer 25 becomes less prone to separation from the first electrode 16.

Thus, the thermal head X1 according to the present embodiment comprises: the substrate 7; the first electrode 16; the heat generating section 9; the common electrode 17 (second electrode); the resin layer 18; and the protective layer 25. The first electrode 16 is located on the substrate 7. The heat generating section 9 is located on the substrate 7. The second electrode (common electrode 17) is located on the substrate 7 so as to be electrically connected to the heat generating section 9 and the first electrode 16. The resin layer 18 is located on the first electrode 16. The protective layer 25 is located on the resin layer 18 and, contains an inorganic material. The resin layer 18 has the first portion inserted in the first electrode 16. The structure described above defines the basic structure of the thermal head X1 in this embodiment. Other constituents and arrangement than those in the basic structure are not essential and may be subjected to appropriate changes. By virtue of this basic structure, the thermal head X1 in this embodiment can achieve a lessening of the stress concentrated at the interface between the first electrode 16 and the protective layer 25, and thus restrain the protective layer 25 against separation from the first electrode 16.

Moreover, in the thermal head X1 according to this embodiment, the first portion 18*a* may extend in a direction inclined to the thickness direction of the first electrode 16 when viewed in a section. This configuration makes it possible to increase the area of contact between the first portion 18*a* and the first electrode 16, and thereby achieve further enhancement in the strength of adhesion between the first electrode 16 and the resin layer 18.

Moreover, since the first portion 18*a* extend in a direction inclined to the thickness direction of the first electrode 16, the first portion 18*a* comes behind a portion 16*b* around the discontinuity portion 20 of the first electrode 16. In consequence, the first portion 18*a* catches against the portion 16*b* around the discontinuity portion 20 of the first electrode 16, and thus the resin layer 18 becomes less prone to separation from the first electrode 16.

Moreover, in the thermal head X1 according to this embodiment, the first portion 18*a* may include the second portion 18*b* located in the region E which corresponds to the discontinuity portion 20 in the thickness direction of the first electrode 16, and the third portion 18*c* which is a portion of the first portion 18*a* other than the second portion 18*b*. when such constitution is satisfied, the resin layer 18 is firmly connected to the first electrode 16 by the second portion 18*b* and the third portion 18*c*, and the third portion 18*c* catches against the portion immediately above, namely part of the portion 16*b* around the discontinuity portion 20 of the first electrode 16. This makes it possible to restrain the resin layer 18 against separation from the first electrode 16.

Moreover, in the thermal head X1 according to this embodiment, the third portion 18*c* may be made larger in area than the second portion 18*b* when viewed in a section. When such constitution is satisfied, it is possible to provide an adequately large third portion 18*c*, and the resin layer 18 becomes even less prone to separation from the first electrode 16.

Moreover, in the thermal head X1 according to this embodiment, the first portion 18*a* of the resin layer 18 and other portion of the resin layer 18 than the first portion 18*a* may be connected to each other via the first through hole 17*e*. When such constitution is satisfied, the resin layer 18 located on the common electrode 17 and the first portion 18*a* hold the edge of the common electrode 17 around the first through hole 17*e*. In consequence, the common electrode 17 becomes less prone to separation from the first electrode 16.

Moreover, in the thermal head X1 according to this embodiment, the first portion 18*a* of the resin layer 18 and other portion of the resin layer 18 than the first portion 18*a* may be connected to each other via the second through hole 15*a*. When such constitution is satisfied, the resin layer 18 located on the electrical resistance layer 15 and the first portion 18*a* hold the edge of the electrical resistance layer 15 around the second through hole 15*a*. In consequence, the electrical resistance layer 15 becomes less prone to separation from the first electrode 16.

Moreover, the resin layer 18 may be made greater than the first electrode 16 in length in the sub scanning direction, and the resin layer 18 may be made greater than the first electrode 16 in length in the main scanning direction as seen in a plan view. In this case, since the first electrode 16 is covered with the resin layer 18, the first electrode 16 is insulated by the resin layer 18, and the conduction between the protective layer 25 and the first electrode 16 can be suppressed.

To form the recess 22 of the first electrode 16, a pore-forming material is blended into a paste used as the material for the first electrode 16. That is, the first electrode 16 having the recess 22 can be formed by preparing a paste for forming the first electrode 16 by blending metal particles such as Ag particles and a pore-forming material into epoxy resin, a applying the first electrode 16-forming paste by a thick-film forming technique such as a printing method, and curing the applied paste.

Then, films for forming the electrical resistance layer 15 and various electrodes are formed on the first electrode 16 so that the discontinuity portion 20 is not closed, and patterning is performed thereon. Next, a precursor of the resin layer 18 is applied onto the first electrode 16, and is then cured into the resin layer 18 under heat treatment. In this way, the first portion 18*a* of the resin layer 18 can be formed.

Figure 5:
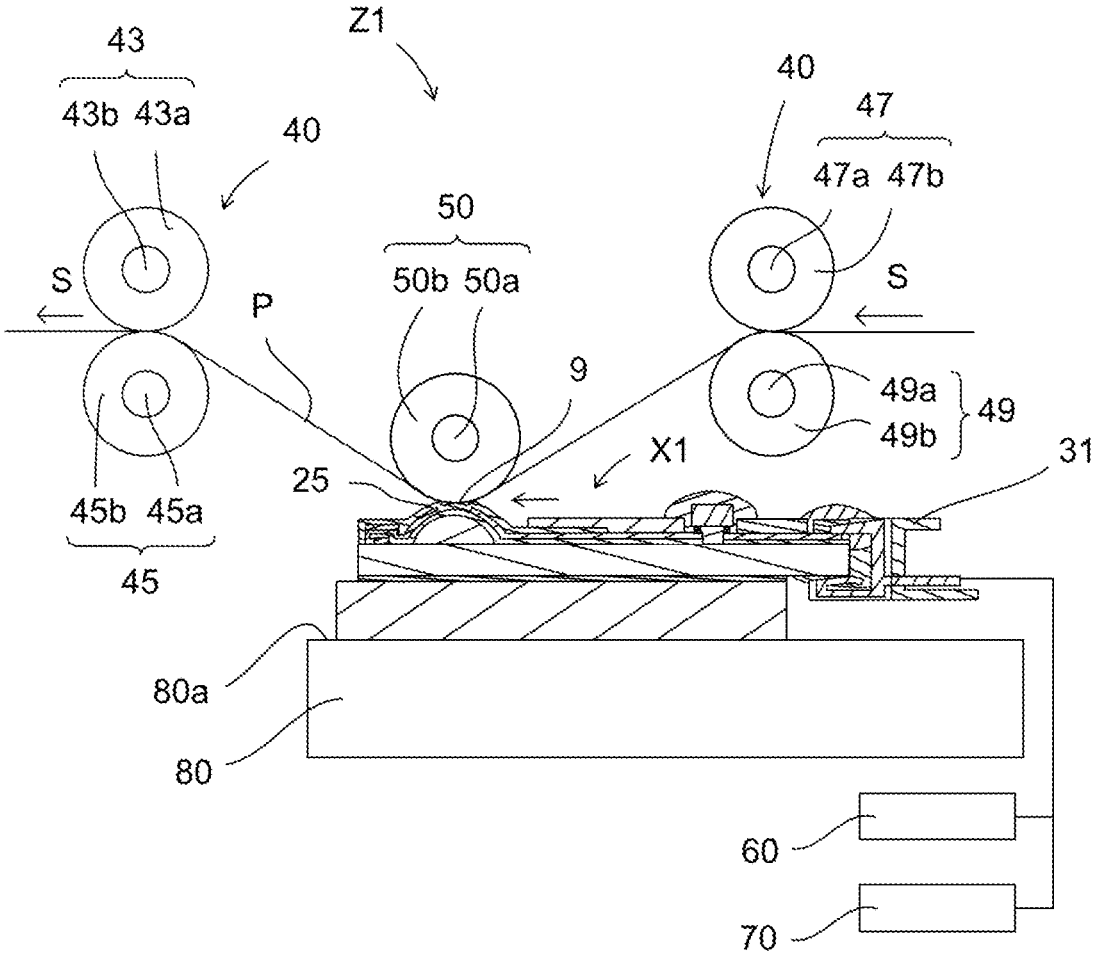
FIG. 5 is a schematic view showing a thermal printer according to the first embodiment.

Next, a thermal printer Z1 comprising the thermal head X1 will be described with reference to FIG. 5.

The thermal printer Z1 according to the present embodiment comprises: the thermal head X1 described above; a conveyance mechanism 40; a platen roller 50; a power supply device 60; and a control unit 70. The thermal head X1 is attached to a mounting face 80*a* of a mounting member 80 disposed in a housing (not shown) for the thermal printer Z1. The thermal head X1 is mounted on the mounting member 80 so as to be oriented along the main scanning direction which is perpendicular to a conveying direction S.

The conveyance mechanism 40 comprises a driving section (not shown) and conveying rollers 43, 45, 47, and 49. The conveyance mechanism 40 serves to convey the recording medium P, such as thermal paper or ink-transferable image-receiving paper, in the direction indicated by arrow S shown in FIG. 5 so that the recording medium P passes over the protective layer 25 located on the plurality of heat generating sections 9 of the thermal head X1. The driving section functions to drive the conveying rollers 43, 45, 47, and 49. For example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, etc. For example, when using ink-transferable image-receiving paper as the recording medium P, the recording medium P is conveyed together with an ink film which is interposed between the recording medium P and the heat generating section 9 of the thermal head X1 (not shown).

The platen roller 50 functions to press the recording medium P against the top of the protective layer 25 located on the heat generating section 9 of the thermal head X1. The platen roller 50 is disposed so as to extend in a direction perpendicular to the conveying direction S, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, etc.

The power supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

In the thermal printer Z1, the recording medium P is conveyed so as to pass over the heat generating section 9 of the thermal head X1, while being pressed against the top of the heat generating section 9 by the platen roller 50, by the conveyance mechanism 40. Then, the thermal printer Z1 performs predetermined printing on the recording medium P by operating the power supply device 60 and the control unit 70 so as to enable the heat generating sections 9 to selectively generate heat. For example, when using image-receiving paper as the recording medium P, printing on the recording medium P is effected by thermally transferring the ink of the non-illustrated ink film, which is conveyed together with the recording medium P, onto the recording medium P.

Second Embodiment

Figure 6:
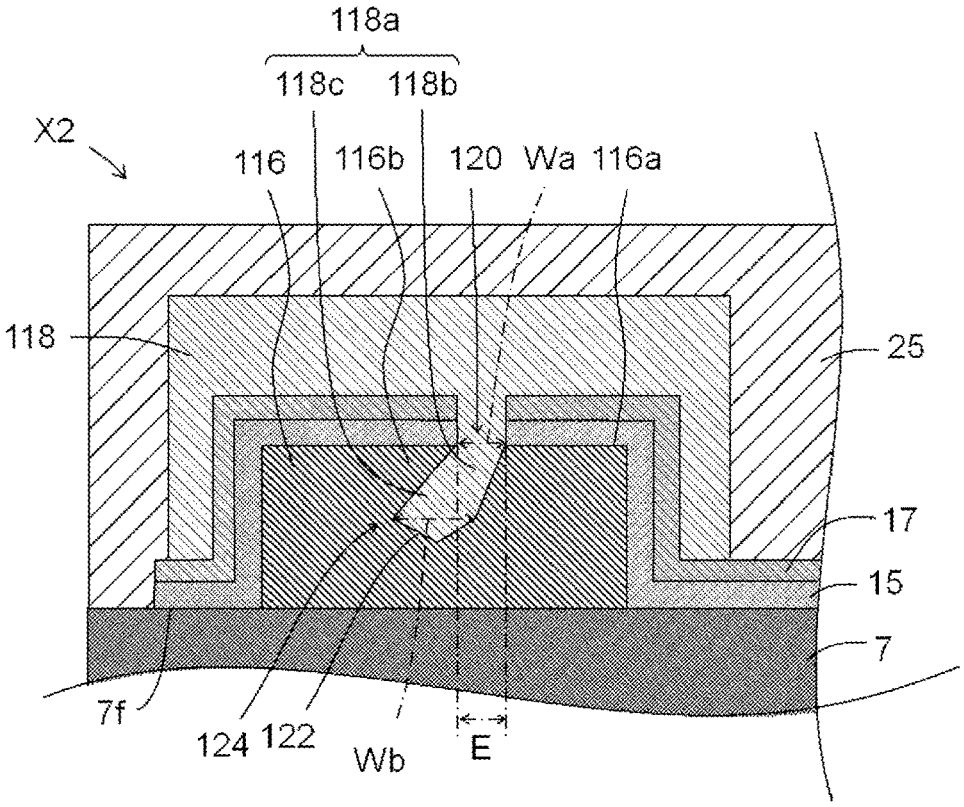
FIG. 6 is a sectional view, corresponding to FIG. 4B, showing the thermal head according to a second embodiment.

A thermal head X2 will be described with reference to FIG. 6. Such members of the thermal head X2 as are identical with those of the thermal head X1 will be identified with the same reference symbols, and overlapping descriptions will be omitted. The thermal head X2 has a first electrode 116 and a resin layer 118 which differ structurally from the first electrode and the resin layer, respectively, of the thermal head X1.

The first electrode 116 has a discontinuity portion 120 at an upper surface 116*a* thereof. Moreover, the first electrode 116 has a recess 122 recessed inwardly from the discontinuity portion 120. The recess 122 extends toward a direction inclined to the thickness direction. The recess 122 has a portion which is larger in width than the discontinuity portion 120 when viewed in a section.

The resin layer 118 is disposed on the first electrode 116 and has a first portion 118*a* inserted in the first electrode 116. The first portion 118*a* is disposed within the recess 122 so as to fill the recess 122. The first portion 118*a* comprises a second portion 118*b* located in a region E and a third portion 118*c* located outside the region E. Moreover, the first portion 118*a* has a wide portion 124 which corresponds to the larger-width portion of the recess 122.

The wide portion 124 is disposed over the region E and the area outside the region E, and is composed of the second portion 118*b* and the third portion 118*c*. A width Wb of the wide portion 124 is greater than a width Wa of the discontinuity portion 120.

In the thermal head X2 according to the present embodiment, the first portion 118*a* has the wide portion 124 which is larger in width than the discontinuity portion 120 when viewed in a section. In this case, owing to the width Wa of the discontinuity portion 120 being smaller than the width Wa of the wide portion 125, when an external force is exerted in an upward direction as viewed in FIG. 6, a part of the first portion 118*a* which is embedded as the wide portion 124 catches against a portion 16*b* around the discontinuity portion 120 of the first electrode 116. In consequence, the resin layer 118 becomes less prone to separation from the first electrode 116. This makes it possible to reduce the likelihood of separation of the protective layer 25 from the first electrode 126.

As employed herein the width Wa of the discontinuity portion 120, as well as the width Wb of the wide portion 124, refers to the length of the recess 122 in the planar direction of the first face 7*f* of the substrate 7. The length can be determined by making measurements on the plane of section of each of the first electrode 116 and the resin layer 118 in the thermal head X2 sectioned in a direction perpendicular to the first face 7*f* of the substrate 7.

Third Embodiment

Figure 7:
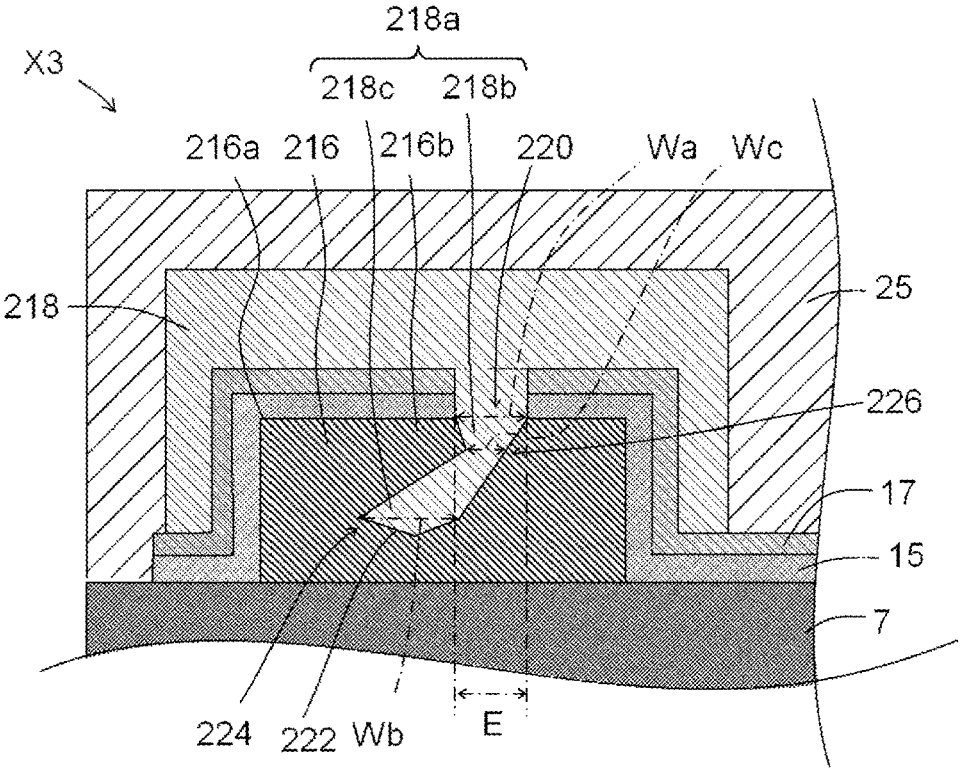
FIG. 7 is a sectional view, corresponding to FIG. 4B, showing the thermal head according to a third embodiment.

A thermal head X3 will be described with reference to FIG. 7. The thermal head X3 has a first electrode 216 and a resin layer 218 which differ structurally from the first electrode and the resin layer, respectively, of the thermal head X1.

The first electrode 216 has a discontinuity portion 220 at an upper surface 216*a* thereof. Moreover, the first electrode 216 has a recess 222 recessed inwardly from the discontinuity portion 220. The recess 222 extends toward a direction inclined to the thickness direction. The recess 222 has a portion which is larger in width than the discontinuity portion 220 when viewed in a section. In addition, the recess 222 has a portion which is smaller in width than the discontinuity portion 220 when viewed in a section.

The resin layer 218 is disposed on the first electrode 216, and has a first portion 218*a* inserted in the first electrode 216. The first portion 218*a* is disposed within the recess 222 so as to fill the recess 222. The first portion 218*a* comprises a second portion 218*b* located in a region E and a third portion 218*c* located outside the region E.

The first portion 218*a* has a wide portion 224 which corresponds to the larger-width portion of the recess 222.

The wide portion 224 is disposed over the region E and the area outside the region E, and is composed of the second portion 218*b* and the third portion 218*c*. A width Wb of the wide portion 224 is greater than a width Wa of the discontinuity portion 220.

Moreover, the first portion 218*a* has a narrow portion 226 which corresponds to the smaller-width portion of the recess 222. The narrow portion 226 is disposed in the region E, and is composed of part of the second portion 218*b*. A width Wb of the narrow portion 226 is smaller than a width Wa of the discontinuity portion 220.

In the thermal head X3 according to the present embodiment, the first portion 218*a* has the narrow portion 226 which is smaller in width than the discontinuity portion 220 when viewed in a section. In this case, when an external force is exerted in an upward direction as viewed in FIG. 7, a part of the first portion 218*a* which is located below the narrow portion 226 catches against the first electrode 216 around the narrow portion 226, and thus the resin layer 218 becomes less prone to separation from the first electrode 216. This makes it possible to reduce the likelihood of separation of the protective layer 25 from the first electrode 216.

Moreover, in the thermal head X3 according to the present embodiment, the first portion 218*a* may have the narrow portion 226 which is smaller in width than the discontinuity portion 220 when viewed in a section, and, the narrow portion 226 may be located between the discontinuity portion 220 and the wide portion 224. When such constitution is provided, the narrow portion 226 catches against the wide portion 224, and thus the resin layer 218 becomes even less prone to separation from the first electrode 216.

Although the narrow portion 226 is, as exemplified, composed solely of the second portion 218*b*, the composition of the narrow portion 226 is not limited to this. The narrow portion 226 may be composed of the second portion 218*b* and the third portion 218*c*. Moreover, the wide portion 224 may be composed solely of the second portion 218*b* or the third portion 218*c*.

Fourth Embodiment

Figure 8:
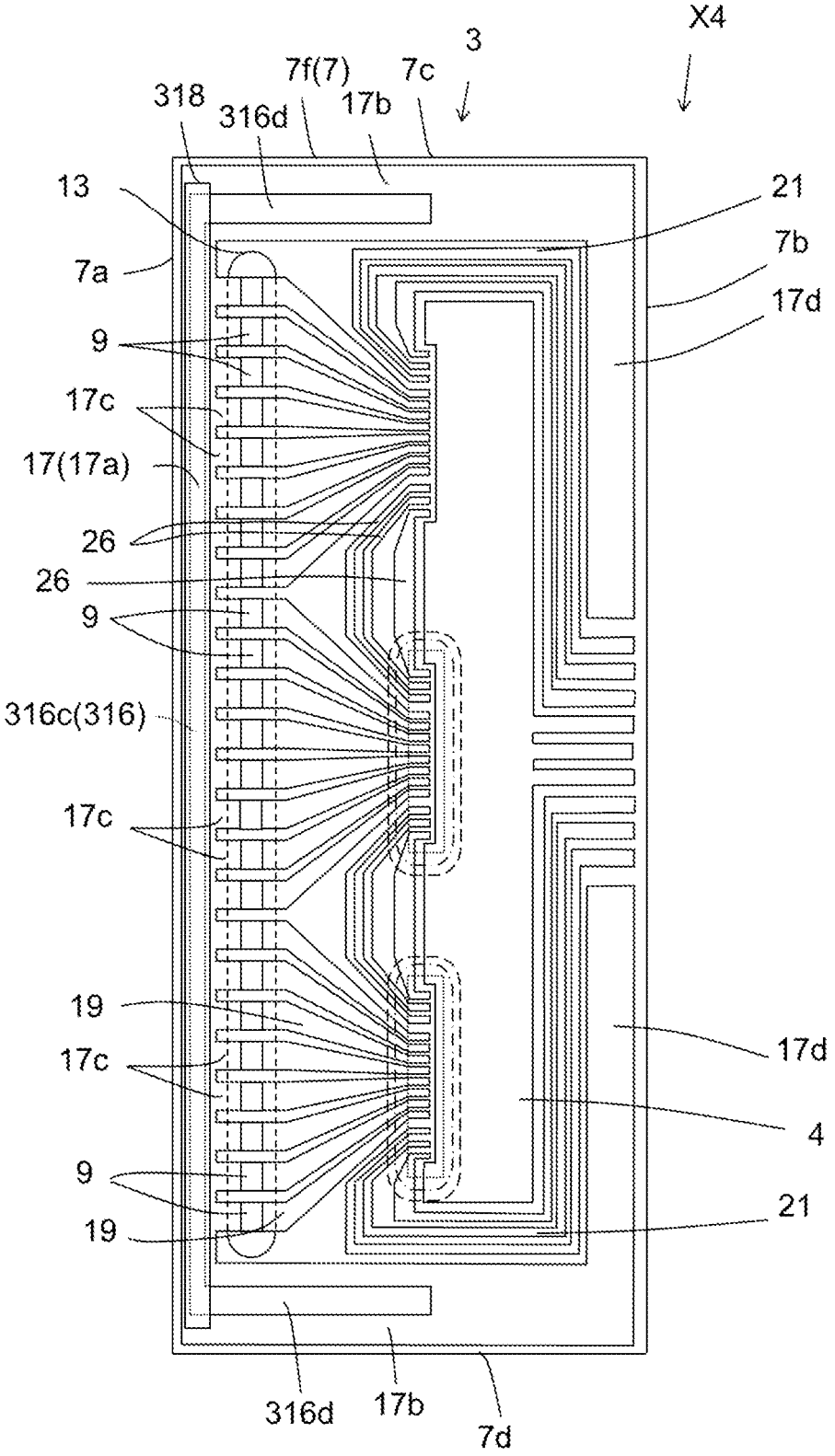
FIG. 8 is a plan view in schematic form showing the structure of the thermal head according to a fourth embodiment.
Figure 9A:
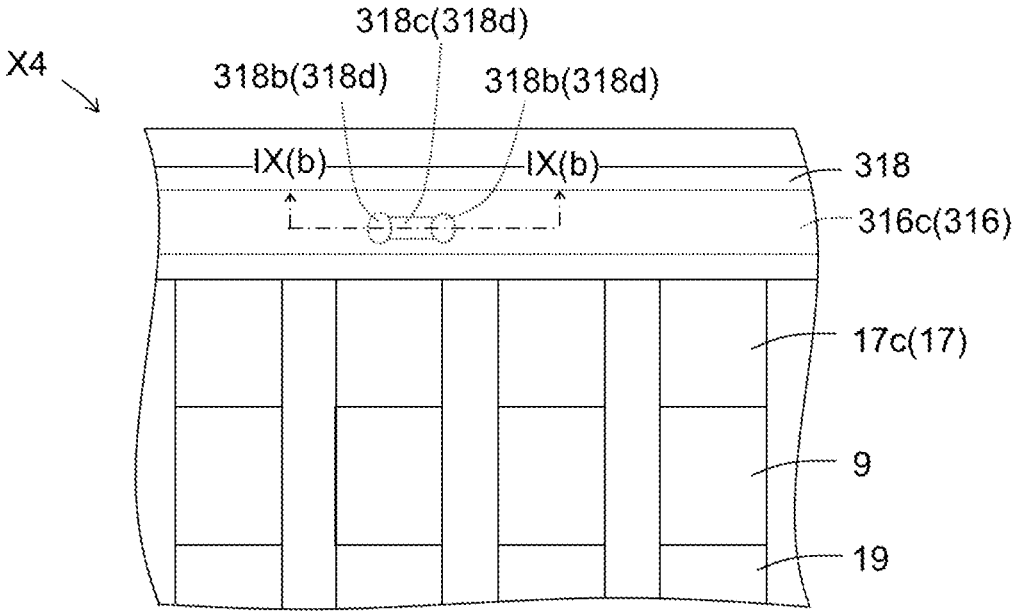
FIG. 9A is a plan view schematically showing a part near an insulating layer in the thermal head shown in FIG. 8.
Figure 9B:
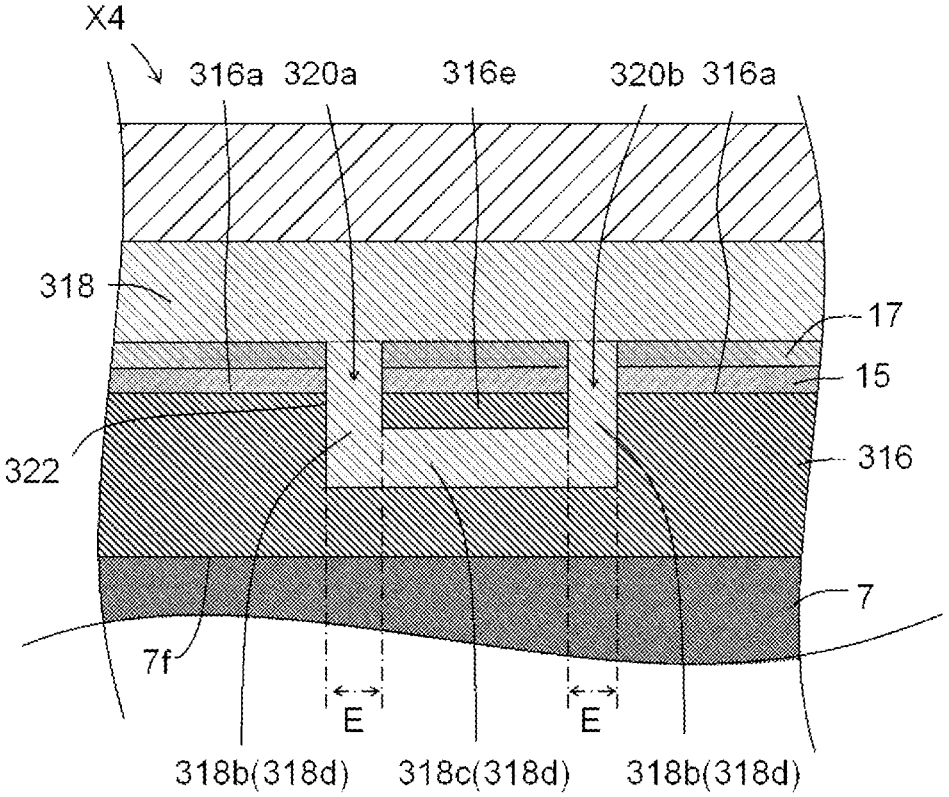
FIG. 9B is a sectional view taken along the line IX(b)-IX(b) shown in FIG. 9A.

A thermal head X4 will be described with reference to FIGS. 8 to 9B. The thermal head X4 has a first electrode 316 and a resin layer 318 which differ structurally from the first electrode and the resin layer, respectively, of the thermal head X1. In FIG. 8, the illustration of the protective layer 25 (refer to FIG. 2), the cover layer 27 (refer to FIG. 2), and the sealing member 12 (refer to FIG. 2) is omitted.

The first electrode 316 comprises a first portion 316*c* extending along the first long side 7*a* of the substrate 7, and second portions 316*d* extending along the first short side 7*c* and the second short side 7*d*, respectively, of the substrate. The first portion 316*c* is located below the main wiring portion 17*a* of the common electrode 17, and, the second portion 316*d* is located below the sub wiring portion 17*b* of the common electrode 17.

The resin layer 318 extends along the first long side 7*a* of the substrate 7 so as to cover the first portion 316*c* of the first electrode 316. The resin layer 318 is made greater than the first portion 316*c* of the first electrode 316 both in length in the main scanning direction and in length in the sub scanning direction. Thus, the first portion 316*c* of the first electrode 316 is covered with the resin layer 318.

Moreover, the second portion 316*d* of the first electrode 316*b* is exposed out of the resin layer 318. Heat which has been transferred from the heat generating section 9 to the first electrode 316 is transmitted from the first portion 316*a* of the first electrode 316 to the second portion 316*b* thereof. Then, owing to the second portion 316*b* being exposed out of the resin layer 318, the heat which has been transmitted to the second portion 316*b* is dissipated from the second portion 316*b*. This makes it possible to reduce accumulation of heat on the first electrode 316.

The first electrode 316 has a discontinuity portion 320*a* and a discontinuity portion 320*b* at an upper surface 316*a* thereof. Moreover, the first electrode 316 has a recess 322 recessed inwardly from each of the discontinuity portion 320*a* and the discontinuity portion 320*b*. The recess 322 extends toward the thickness direction from the discontinuity portion 320*a*, and also extends toward the thickness direction from the discontinuity portion 320*b*. A part of the recess 322 which extends from the discontinuity portion 320*a* and a part the recess 322 which extends from the discontinuity portion 320*b* communicate with each other within the first electrode 316. Thus, the recess 322 is U-shaped when viewed in a section, and, the first electrode 316 includes a portion 316*e* located above the communicating parts of the recess 322.

The resin layer 318 is disposed on the first electrode 316, and has a portion lying within the recess 322. That is, the resin layer 318 comprises a plurality of fourth portions 318*d* located within the first electrode 316. The plurality of fourth portions 318*d* are connected with each other within the first electrode 316. Moreover, the fourth portions 318*d* include a second portion 318*b* located in a region E and a third portion 318*c* located outside the region E.

In the thermal head X4 according to the present embodiment, the resin layer 318 comprises the plurality of fourth portions 318*d* inserted in the first electrode 316, and the plurality of fourth portions 318*d* are connected with each other within the first electrode 316. Thus, the resin layer 318 is configured so that the second portion 318*b* located below the discontinuity portion 320*a* and the second portion 318*b* located below the discontinuity portion 320*b* are connected to each other via the third portion 318*c*.

Thus, on the third portion 318*c*, there is provided the portion 316*e* of the first electrode 316 located above the communicating parts of the recess 322. In consequence, when the resin layer 318 is subjected to an external force exerted in an upward direction as viewed in FIG. 9B, the resin layer 318 catches against the portion 316*e* of the first electrode 316 located above the communicating parts of the recess 322. This makes it possible to restrain the resin layer 318 against separation from the first electrode 316.

In this construction, to form the recess 322, a pore-forming material is blended into a paste used as the material for the first electrode 316. At this time, as the pore-forming material, it is desirable to use, in addition to a spherical pore-forming material, a columnar pore-forming material having an aspect ratio of 2 or more. Moreover, a ring-shaped pore-forming material may be used.

While one embodiment of the invention has been described heretofore, it should be understood that the invention is not limited to the above-described embodiments, and that various modifications and changes are possible without departing from the scope of the invention. For example, although the thermal printer Z1 comprising the thermal head X1 according to the first embodiment has been shown herein, the invention is not limited to this, and, any of the thermal heads X2 to X4 may be incorporated in the thermal printer Z1. Moreover, the thermal heads X1 to X4 according to a plurality of embodiments may be used in combination.

Moreover, although a thin-film head having a thin heat generating section 9 obtained by designing the electrical resistance layer 15 in thin-film form has been described as exemplification, the invention is not limited to this. The invention may be embodied as a thick-film head having a thick heat generating section 9 which is obtained by patterning of various electrodes and subsequently forming the electrical resistance layer 15 by printing.

Moreover, although a flat-type head having the heat generating section 9 formed on the first face 7*f* of the substrate 7 has been described as exemplification, the invention may be embodied as an edge-type head in which the heat generating section 9 is disposed on an end face of the substrate 7.

The sealing member 12 and the hard coating 29 for covering the driving IC 11 may be formed of the same material. In this case, the hard coating 29 and the sealing member 12 may be formed together at one time by performing, concurrently with printing of the hard coating 29, printing on a region where the sealing member 12 is to be formed.

REFERENCE SIGNS LIST

X1-X4: Thermal head
Z1: Thermal printer
E: Region
1: Heat dissipating plate
3: Head base body
7: Substrate
9: Heat generating section
11: Driving IC
13: Heat storage layer
16, 116, 216, 316: First electrode
16*a*, 116*a*, 216*a*, 316*a*: Upper surface
17: Second electrode (common electrode)
18, 118, 218, 318: Resin layer
18*a*, 118*a*, 218*a*, 318*a*: First portion
18*b*, 118*b*, 218*b*, 318*b*: Second portion
18*c*, 118*c*, 218*c*, 318*c*: Third portion
318*d*: Fourth portion
20, 120, 220, 320: Discontinuity portion
22, 122, 222, 322: Recess
25: Protective layer
27: Cover layer
31: Connector
124, 224: Wide portion
226: Narrow portion

The invention claimed is:

1. A thermal head comprising:
a substrate;
a first electrode located on the substrate and comprising a recess;
a heat generating section located on the substrate;
a resin layer comprising a base portion and a first portion, the base portion located on the first electrode, the first portion located in the recess, wherein the first portion and the base portion are connected to each other via the first through hole;
a protective layer located on the resin layer, the protective layer comprising an inorganic material; and
a second electrode located on the substrate and electrically connected to the heat generating section and the first electrode, wherein the second electrode is located between the first electrode and the resin layer in a stacking direction of the first electrode and the protective layer and is provided with a first through hole which is located above the first portion.

2. The thermal head according to claim 1, wherein the first portion extends in a direction that crosses a stacking direction of the first electrode and the protective layer, when viewed in a section of the thermal head.

3. The thermal head according to claim 1, further comprising:
an electrical resistance layer located between the first electrode and the second electrode in the stacking direction,
wherein the electrical resistance layer is provided with a second through hole which is located on the first portion, and
the first portion and the base portion are connected to each other via the second through hole.

4. A thermal printer, comprising:
the thermal head according to claim 1;
a conveyance mechanism which conveys a recording medium so as to pass over the heat generating section; and
a platen roller which presses the recording medium.

5. A thermal head comprising:
a substrate;
a first electrode located on the substrate and comprising a recess wherein, when viewed in a section of the thermal head the first electrode has a discontinuity portion at part of an upper surface thereof;
a heat generating section located on the substrate;
a second electrode located on the substrate and electrically connected to the heat generating section and the first electrode;
a resin layer comprising a base portion and a first portion, the base portion located on the first electrode, the first portion located in the recess, wherein the first portion comprises a second portion located in a region which corresponds to the discontinuity portion, and a third portion which is a portion of the first portion other than the second portion in a stacking direction of the first electrode and a protective layer;
wherein the protective layer is located on the resin layer and comprises an inorganic material.

6. The thermal head according to claim 5, wherein the third portion is greater in area than the second portion when viewed in a section of the thermal head.

7. The thermal head according to claim 5, wherein the first portion has a wide portion which is larger in width than the discontinuity portion when viewed in a section of the thermal head.

8. The thermal head according to claim 7, wherein, when viewed in a section of the thermal head, the first portion has a narrow portion which is smaller in width than the discontinuity portion, and the narrow portion is located between the discontinuity portion and the wide portion.

9. The thermal head according to claim 5, wherein the first portion has a narrow portion which is smaller in width than the discontinuity portion when viewed in a section of the thermal head.

10. A thermal printer, comprising:
the thermal head according to claim 5;
a conveyance mechanism which conveys a recording medium so as to pass over the heat generating section; and
a platen roller which presses the recording medium.

11. The thermal head according to claim 5, wherein the first portion extends in a direction that crosses a stacking direction of the first electrode and the protective layer, when viewed in a section of the thermal head.

12. A thermal head comprising:

a substrate;

a first electrode located on the substrate and comprising a recess;

a heat generating section located on the substrate;

a second electrode located on the substrate and electrically connected to the heat generating section and the first electrode;

a resin layer comprising a base portion and a first portion, the base portion located on the first electrode, the first portion located in the recess, wherein the resin layer comprises a plurality of fourth portions inserted in the first electrode, and the plurality of fourth portions are connected with each other within the first electrode; and a protective layer located on the resin layer, the protective layer comprising an inorganic material.

13. A thermal printer, comprising:

the thermal head according to claim 12;

a conveyance mechanism which conveys a recording medium so as to pass over the heat generating section; and a platen roller which presses the recording medium.

14. The thermal head according to claim 12, wherein the first portion extends in a direction that crosses a stacking direction of the first electrode and the protective layer, when viewed in a section of the thermal head.

* * * * *